US008935827B2

(12) United States Patent
Breit

(10) Patent No.: US 8,935,827 B2
(45) Date of Patent: Jan. 20, 2015

(54) STEAM APPLIANCE

(75) Inventor: Oliver Rudolph Breit, Mid Levels (HK)

(73) Assignee: Euro-Pro Operating LLC, Newton, MA (US)

( * ) Notice: Subject to any disclaimer, the term of this patent is extended or adjusted under 35 U.S.C. 154(b) by 382 days.

(21) Appl. No.: 12/567,734

(22) Filed: Sep. 25, 2009

(65) Prior Publication Data

US 2011/0073140 A1 Mar. 31, 2011

(51) Int. Cl.
*A47L 5/24* (2006.01)
*B08B 3/00* (2006.01)

(52) U.S. Cl.
CPC ..... *B08B 3/00* (2013.01); *B08B 2230/01* (2013.01)
USPC ..... 15/344; 15/321

(58) Field of Classification Search
USPC ..... 15/228, 320, 321, 322, 344, 353, 401, 15/403, 414
See application file for complete search history.

(56) References Cited

U.S. PATENT DOCUMENTS

| | | | | |
|---|---|---|---|---|
| 5,749,120 | A * | 5/1998 | Amoretti | 15/339 |
| 5,795,626 | A * | 8/1998 | Gabel et al. | 427/458 |
| 6,295,691 | B1 | 10/2001 | Chen | |
| 7,475,448 | B2 | 1/2009 | Rosenzweig et al. | |
| 2003/0033687 | A1 | 2/2003 | Tsen | |
| 2003/0041406 | A1 | 3/2003 | Wu | |
| 2003/0145880 | A1 | 8/2003 | Jepsen et al. | |
| 2005/0125934 | A1* | 6/2005 | Reese | 15/320 |
| 2006/0000048 | A1* | 1/2006 | Rosenzweig et al. | 15/320 |
| 2006/0000241 | A1* | 1/2006 | Rosenzweig | 68/5 R |
| 2007/0144735 | A1 | 6/2007 | Lloyd et al. | |
| 2010/0212098 | A1* | 8/2010 | Vrdoljak | 15/209.1 |

FOREIGN PATENT DOCUMENTS

| | | | |
|---|---|---|---|
| CN | 2395719 | Y | 9/2000 |
| CN | 2488607 | Y | 5/2002 |
| CN | 2492185 | Y | 5/2002 |
| CN | 1440710 | A | 9/2003 |
| CN | 2644027 | Y | 9/2004 |
| CN | 1794942 | A | 6/2006 |
| CN | 201058315 | Y | 5/2008 |
| CN | 201312788 | Y | 9/2009 |
| EP | 1 421 892 | A1 | 5/2004 |
| JP | 3080363 | U | 9/2001 |
| JP | 2002-022393 | A | 1/2002 |
| KR | 20080005363 | U | 11/2008 |
| WO | WO 2007/144735 | A2 | 12/2007 |

OTHER PUBLICATIONS

Novelty Evaluation Report for Chinese Application No. 201020138419.0.
Evaluation Report for Chinese Application No. 201020138419.0.
Report of Utility Model Technical Opinion for JP 2010-001168 mailed Jun. 15, 2011.

* cited by examiner

*Primary Examiner* — Robert Scruggs
(74) *Attorney, Agent, or Firm* — Wolf, Greenfield & Sacks, P.C.

(57) ABSTRACT

A steam appliance system in which steam is delivered from a steam generation unit to a steam applicator via a steam conduit which extends through a handle of the steam applicator. The steam conduit may be removable from the handle.

9 Claims, 3 Drawing Sheets

STEAM APPLIANCE

FIELD OF THE INVENTION

The invention relates generally to steam appliances, and more specifically to the transfer of steam from a stream generation unit to a steam applicator.

DISCUSSION OF THE RELATED ART

Steam appliances are used in the home to apply steam to floors for cleaning and sanitizing. Various types of steam appliances are known, including canister steam appliances and self-contained steam mops, for example. Canister steam appliances typically include a rollable steam generation unit, a hose to transfer the steam from the steam generation unit, a pole, and a mop head or other accessory which is connected to the end of the pole. Self-contained steam mops include a steam generation unit mounted directly on the pole. Handheld steam appliances typically include a container and a nozzle for discharging steam directly from the mouth of the container.

SUMMARY

Embodiments of the invention provided herein are directed to steam appliance systems and steam applicators in which steam is provided to a steam applicator through a conduit which runs along a handle for the steam applicator.

According to one embodiment of the invention, a steam appliance includes a steam generation unit, a steam applicator, and a steam conduit attachable to the steam generation unit to guide steam to the steam applicator, the steam applicator being connectable to the steam conduit. The steam conduit has a steam outlet. The steam appliance further includes a handle attachable to the steam conduit such that the handle is proximal to the steam applicator. A portion of the steam conduit runs along the handle and communicates with the steam applicator.

Various embodiments of the present invention provide certain advantages. Not all embodiments of the invention share the same advantages and those that do may not share them under all circumstances.

Further features and advantages of the present invention, as well as the structure of various embodiments of the present invention are described in detail below with reference to the accompanying drawings.

BRIEF DESCRIPTION OF THE DRAWINGS

The accompanying drawings are not intended to be drawn to scale. For purposes of clarity, not every component may be labeled in every drawing. In the drawings.

DETAILED DESCRIPTION

Embodiments of the invention provided herein are directed to steam appliance systems in which steam is delivered from a steam generation unit to a steam applicator via a steam conduit which extends through a handle of the steam applicator. By limiting the amount of steam that is released within the handle, various configurations of the system may improve the efficiency of steam delivery to the steam applicator and/or reduce the temperature of the steam applicator handle. Several different removable steam applicators may be provided with the system. In some embodiments, each steam applicator includes an attached handle, while in other embodiments, a handle is provided on the main system and various steam applicators are attachable to the handle. When each steam applicator includes an attached handle, the steam conduit may be insertable into and removable from the handles.

In some embodiments, the steam conduit extends fully through an interior of a steam applicator handle and into a steam inlet of the steam applicator. In some embodiments, the steam conduit extends at least partially through the steam applicator handle, and a steam outlet of the steam conduit communicates with the steam applicator. The steam conduit may extend far enough through the handle such that the steam conduit outlet is positioned distal to the steam applicator handle, or in some cases, distal to a hand grasp portion of the steam applicator handle. Such a configuration may limit the amount of heat transferred from the steam to the handle, and preserve steam for delivery to the steam applicator.

Embodiments of steam appliance systems disclosed herein include multiple removable steam applicators which have attached handles. The steam conduit is removable from the steam applicator handle in some embodiments. This configuration may include an elongated stem which is attached to a distal end of a flexible hose. The elongated stem is extendable into, and in some cases, beyond the handle. By providing a removable steam conduit which extends into the handle, a seal does not necessarily need to be established between two distinct conduit portions at a proximal end of the handle each time a steam applicator is attached to the steam appliance.

Figure 1:
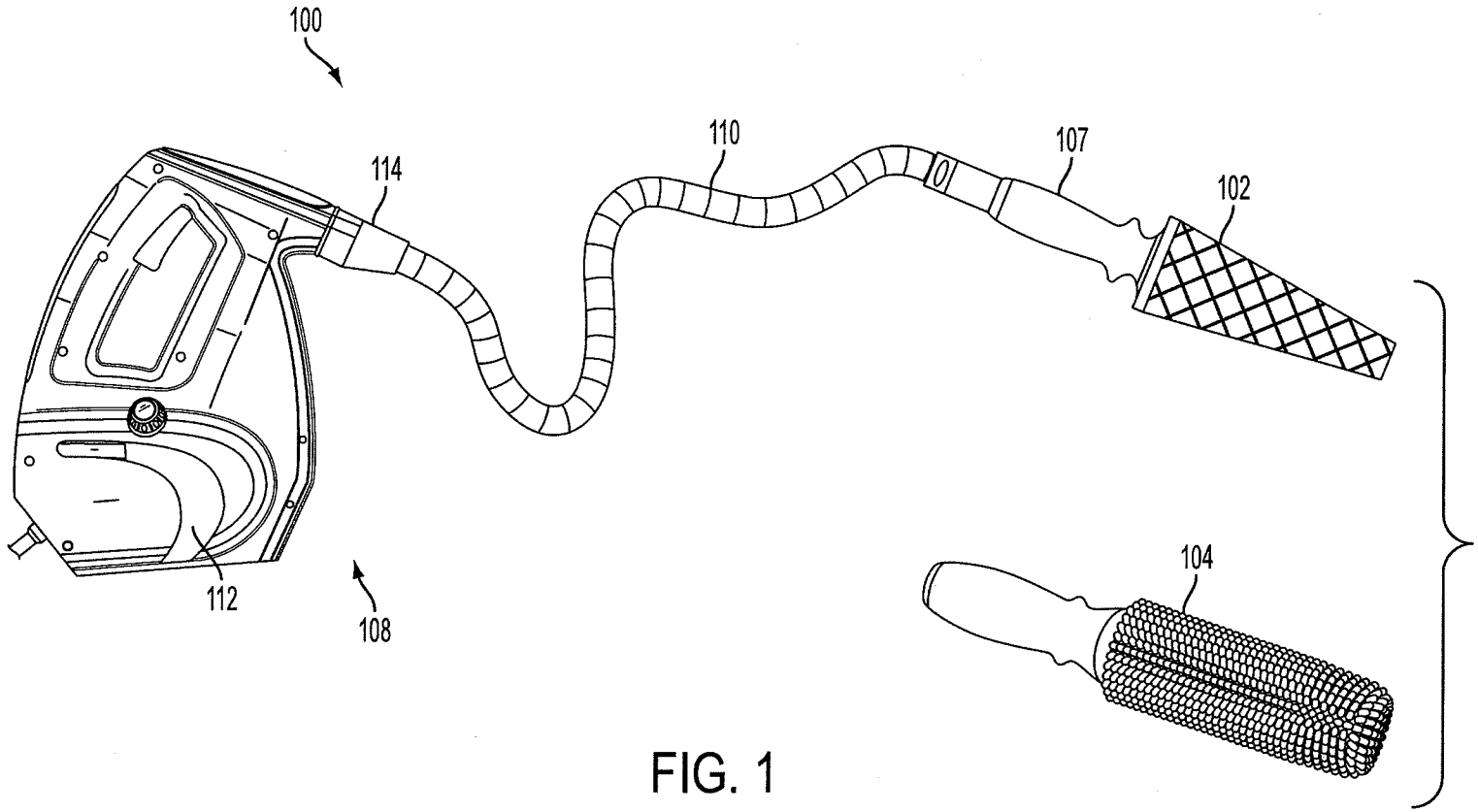
FIG. 1 is a side view of a steam appliance system according to one embodiment of the invention.

A steam appliance system 100 including two attachable steam applicators 102, 104 is shown in FIG. 1. Steam applicators 102, 104 each may include a handle 107 which is permanently or detachably attached to the applicator. In the embodiment of FIG. 1, steam appliance system 100 includes a steam generation unit 108, a steam conduit 110, and attached steam applicator 102. Steam generation unit 108 may include any suitable type of steam generation system, for example a cool water reservoir 112 and an aluminum die-cast steam generator (not shown). In some embodiments, water may be heated to its boiling point within its reservoir to create steam. It should be noted that the method of steam generation is not intended to be a limiting aspect of the invention.

In some embodiments, the steam generation unit 108 is handheld, while in other embodiments the steam generation unit may include a shoulder strap, or include wheels or other rollers.

Steam conduit 110 is a flexible hose in some embodiments. Steam conduit 110 may be attachable to steam generation unit 108 with any suitable attachment 114, including a removable connector, such as a bayonet connector.

Figure 2:
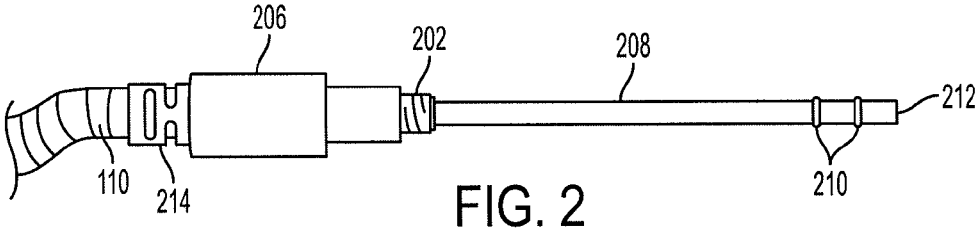
FIG. 2 is a side view of a steam conduit including an elongated stem according to one embodiment of the invention.

To facilitate the removal and attachment of various steam applicators, steam conduit 110 may be provided with an elongated stem 208, as shown in FIG. 2. In this embodiment, a steam appliance includes an externally-threaded connector portion 202 attached to steam conduit 110. A hand grasp portion 206 is attached to steam conduit 110 and threaded connector portion 202 for the user to grip when attaching or detaching steam conduit 110 and handle 107.

Figure 4:
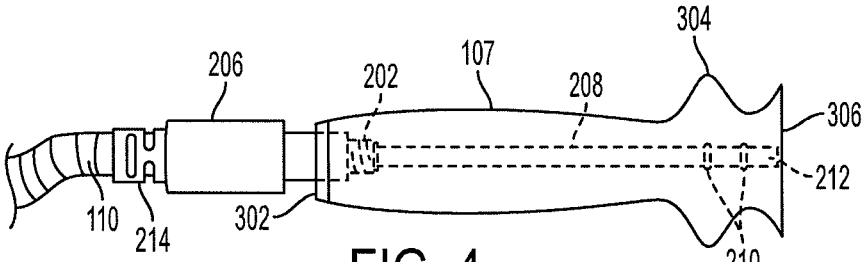
FIG. 4 is a side view of an elongated stem inserted into a steam applicator handle.

Steam conduit includes an elongated stem 208 to guide steam through handle 107 and to a steam outlet 212. O-rings 210 or other seal elements may be positioned on stem 208 to establish a seal with the steam applicator, whether that seal be within the handle of the steam applicator, or within the steam applicator itself. A stress release sleeve 214 may be included at the junction of steam conduit 110 and hand grasp portion 206 as best illustrated in FIG. 4.

Figure 3:
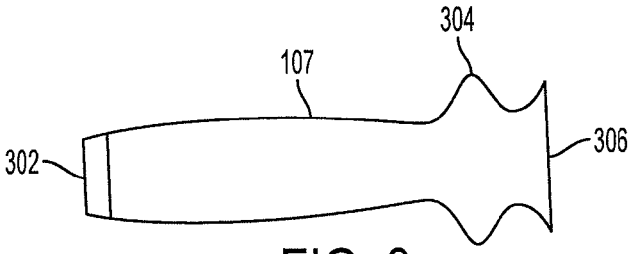
FIG. 3 is a side view of a steam applicator handle for use with the steam conduit illustrated in FIG. 2.

Elongated stem 208 may extend into handle 107 through an opening, such as a first opening 302 as shown in FIG. 3. In some embodiments, elongated stem 208 extends at least partially into handle 107. In some embodiments, elongated stem 208 extends through handle 107, and steam outlet 212 is positioned past a hand grasp portion of handle 107 (the hand grasp portion being the portion of handle 107 proximal to a guard 304 in the embodiment of FIG. 3). By positioning steam outlet 212 distal to the hand grasp portion, heat transfer to the handle may be limited.

In some embodiments, elongated stem 208 extends fully through handle 107, extending out of a second opening 306, and into a steam applicator which is attached to handle 107. In such embodiments, steam outlet 212 of steam conduit 210 is positioned distal to the entirety of handle 107. Configurations described herein may help to preserve steam for delivery to the steam applicator, thereby improving the efficiency of delivering steam to the steam applicator.

A method of using steam conduit 210 includes inserting elongated stem 208 into the handle of a first steam applicator, attaching the conduit to the handle of the first steam applicator, using the steam appliance to clean and sanitize surfaces, removing the elongated stem 208 from the steam applicator, inserting elongated stem 208 into the handle of a second steam applicator, and attaching the conduit to the handle of the second steam applicator.

Steam applicator 102 may be rotated about an end-to-end direction of the steam applicator or about an end-to-end direction of handle 107. In some embodiments, pitch and/or yaw rotations may be permitted as well. A universal joint may be used in addition to, or instead of, the structures described herein.

Connector portion 202 may engage with a complementary connector portion (not shown) contained within handle 107. Insulation may be provided within handle 107 in some embodiments. In operation, when a user inserts the externally-threaded connector portion 202 into the complementary internally-threaded connector portion (not shown) within the handle 107, an un-threaded connector portion 217 may be exposed between the handle 107 and the connector 206 as best illustrated in FIG. 4. This exposed, un-threaded connector portion 217 may be similar to the stress release sleeve 214 with the exception that it is an exposed sleeve without any threading and disposed between the handle 107 and the connector 206.

For purposes herein, the terms "connect", "connected", "connection", "attach", "attached" and "attachment" refer to direct connections and attachments, indirect connections and attachments, and operative connections and attachments. For example, steam applicator 102 is considered to be connected to steam conduit 110 even though steam applicator is directly connected to handle 107 which is, in turn, connected to steam conduit 110. Also for purposes herein, the terms "connectable", "attachable", "removable", "extendable" etc. refer both to components which can be connected, attached, removed, extended, etc., and also refer to components which are connected, attached, removed and extended.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A steam appliance, comprising:
a steam generation unit;
a steam applicator;
a steam conduit attachable to the steam generation unit to guide steam to the steam cleaning applicator, the steam applicator being connectable to the steam conduit, and the steam conduit having a steam outlet;
a handle attachable to the steam conduit such that the handle is proximal to the steam cleaning applicator;
a rigid elongated stem attachable to the steam outlet and extendable into the handle such that the rigid elongated stem is positioned distal to the handle to guide steam from the steam outlet to the steam cleaning applicator, the rigid elongated stem being detachable from the handle; and
a connector coupling the handle to the steam conduit for attaching or detaching the handle and the steam conduit, the connector having;
(a) an external thread portion position on either the handle or the steam conduit,
(b) an internal thread portion positioned on the other of the handle and the steam conduit, and
(c) an exposed, un-threaded portion between the handle and the connector.

2. The steam cleaning appliance as in claim 1, wherein the steam cleaning applicator includes a steam-permeable fabric positioned on a support frame extending from the handle.

3. The steam cleaning appliance as in claim 1, wherein the rigid elongated stem has a reduced cross-sectional dimension as compared to the steam conduit.

4. The steam cleaning appliance as in claim 1, wherein the rigid elongated stem includes a seal element to establish a seal with the steam cleaning applicator.

5. A steam cleaning appliance, comprising:
a steam generation unit;
a steam cleaning applicator;
a steam conduit attachable to the steam generation unit to guide steam to the steam cleaning applicator, the steam cleaning applicator being connectable to the steam conduit, and the steam conduit having a steam outlet; and
a handle attachable to the steam conduit such that the handle is proximal to the steam cleaning applicator and the steam outlet is distal to the handle, wherein:
a rigid elongated portion of the steam conduit is extendable through the handle and communicates with the steam cleaning applicator, the rigid elongated portion of the steam conduit removable from the handle; and
a connector coupling the handle to the steam conduit for attaching or detaching the handle and the steam conduit, the connector having:
(a) an external thread portion position on either the handle or the steam conduit,
(b) an internal thread portion positioned on the other of the handle and the steam conduit, and
(c) an exposed, un-threaded portion between the handle and the connector.

6. A steam cleaning appliance, comprising:
a steam generation unit;
a steam cleaning applicator; and
a steam conduit attachable to the steam generation unit to guide steam to the steam cleaning applicator, the steam conduit having a handle to which the steam cleaning applicator is attachable, wherein:

the steam conduit includes a rigid elongated stem extendable through the handle such that a steam outlet of the rigid elongated stem is positioned distal to a hand grasp portion of the handle and communicates with the steam cleaning applicator;

a connector coupling the handle the steam conduit for attaching or detaching the handle and the steam conduit, the connector having:

(a) an external thread portion position on either the handle or the steam conduit, (b) an internal thread portion positioned on the other of the handle and the steam conduit, and (c) an exposed, un-threaded portion between the handle and the connector; and the steam cleaning applicator including a steam-permeable fabric positioned on a support frame extending from the handle.

7. The steam cleaning appliance as in claim 6, wherein the rigid elongated stem is extendable through the handle, such that the steam outlet of the rigid elongated stem is positioned distal to the handle.

8. The steam cleaning appliance as in claim 6, wherein the rigid elongated stem has a reduced cross-sectional dimension as compared to the steam conduit.

9. The steam cleaning appliance as in claim 6, wherein the rigid elongated stem includes a seal element to establish a seal with the steam cleaning applicator.

* * * * *

UNITED STATES PATENT AND TRADEMARK OFFICE

CERTIFICATE OF CORRECTION

PATENT NO. : 8,935,827 B2
APPLICATION NO. : 12/567734
DATED : January 20, 2015
INVENTOR(S) : Oliver Rudolph Breit It is certified that error appears in the above-identified patent and that said Letters Patent is hereby corrected as shown below:

IN THE CLAIMS:

At column 4, claim 1, line 12 before the word "applicator" add the word -- cleaning --.

Signed and Sealed this
Ninth Day of June, 2015

Michelle K. Lee

Michelle K. Lee
*Director of the United States Patent and Trademark Office*